US010287903B2

(12) United States Patent
Burdgick et al.

(10) Patent No.: US 10,287,903 B2
(45) Date of Patent: May 14, 2019

(54) STEAM TURBINE DRUM NOZZLE HAVING ALIGNMENT FEATURE, RELATED ASSEMBLY, STEAM TURBINE AND STORAGE MEDIUM

(71) Applicant: General Electric Company, Schenectady, NY (US)

(72) Inventors: Steven Sebastian Burdgick, Schenectady, NY (US); Mark Richard Delorenzo, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 453 days.

(21) Appl. No.: 15/092,090

(22) Filed: Apr. 6, 2016

(65) Prior Publication Data

US 2017/0292391 A1 Oct. 12, 2017

(51) Int. Cl.
*F01D 9/04* (2006.01)

(52) U.S. Cl.
CPC ..... *F01D 9/042* (2013.01); *F01D 9/041* (2013.01); *F05D 2220/31* (2013.01); *F05D 2230/20* (2013.01); *F05D 2230/64* (2013.01); *F05D 2240/128* (2013.01)

(58) Field of Classification Search
CPC ..... F05D 2230/20; F05D 2240/128
See application file for complete search history.

(56) References Cited

U.S. PATENT DOCUMENTS 6,939,106 B2 * 9/2005 Murphy ..... F01D 5/30 415/209.2
7,329,098 B2 2/2008 Burdgick
7,419,355 B2 9/2008 Burdgick
(Continued)

FOREIGN PATENT DOCUMENTS

EP 1 793 088 A2 6/2007
EP 2 386 721 A1 11/2011

OTHER PUBLICATIONS

Extended European Search Report and Opinion issued in connection with corresponding EP Applicatiion No. 17164363.8 dated Aug. 28, 2017.

(Continued)

*Primary Examiner* — Christopher Verdier
*Assistant Examiner* — Jason G Davis
(74) *Attorney, Agent, or Firm* — Ernest G. Cusick; Hoffman Warnick LLC

(57) ABSTRACT

Various embodiments include a steam turbine drum nozzle, along with a related assembly and steam turbine. Particular embodiments include a nozzle having: an airfoil; a radially inner sidewall coupled with a first end of the airfoil; and a radially outer sidewall coupled with a second end of the airfoil, the second end opposing the first end, wherein the radially outer sidewall includes: a first section radially outward of the airfoil; a thinned section coupled with the first section; and a second section coupled with the thinned section radially outward of the airfoil, the second section having a radially outer face and a circumferentially facing side abutting the radially outer face, wherein the second section includes a circumferentially extending slot, and wherein the second section includes a relief slot extending into a body of the second section from the circumferentially facing side.

18 Claims, 7 Drawing Sheets

(56) References Cited

U.S. PATENT DOCUMENTS

| | | | | |
|---|---|---|---|---|
| 7,722,314 | B2 | 5/2010 | Burdgick | |
| 8,834,113 | B2 | 9/2014 | Schaus et al. | |
| 8,905,712 | B2 | 12/2014 | Burdgick et al. | |
| 9,175,568 | B2 * | 11/2015 | Ryan | B22F 3/1055 |
| 9,828,866 | B2 * | 11/2017 | Fitts | F01D 9/042 |
| 2004/0086383 | A1 | 5/2004 | Couture et al. | |
| 2006/0251514 | A1 | 11/2006 | Burdgick | |
| 2012/0114470 | A1 | 5/2012 | Burdgick | |
| 2014/0072419 | A1 | 3/2014 | Joshi et al. | |

OTHER PUBLICATIONS

Burdgick, S. S., et al., Turbomachine alignment key and related turbomachine, GE CoPending U.S. Appl. No. 15/092,106, filed Apr. 6, 2016.

* cited by examiner

STEAM TURBINE DRUM NOZZLE HAVING ALIGNMENT FEATURE, RELATED ASSEMBLY, STEAM TURBINE AND STORAGE MEDIUM

BACKGROUND OF THE INVENTION

The subject matter disclosed herein relates to steam turbines. Specifically, the subject matter disclosed herein relates to nozzles in steam turbines.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Steam turbine drum nozzles are loaded into the diaphragm (drum) within a circumferential slot or groove. These drum nozzles are assembled similarly to conventional nozzle assemblies, however, these drum nozzles conventionally include a dovetail/hooked interface with the (radially) outer diaphragm ring, and a cover at the opposite end, which defines a radially inner flowpath. These drum nozzle assemblies do not conventionally include an inner diaphragm ring, as the radially inner cover acts to define the flowpath. When loading drum nozzles into the diaphragm ring, the first nozzle proximate one of the horizontal joints is conventionally held in position while a pin is wedged behind the nozzle to hold it in place. The wedge corner of the nozzle dovetail is typically measured and aligned with the horizontal joint of the diaphragm ring. Following placement of the first nozzle, additional nozzles are then placed within the circumferential slot until the half stage (either upper or lower) of the assembly is complete. When the final nozzle is placed in the slot, additional measurements are performed to determine whether and how much that nozzle and/or adjacent nozzles will need to be machined (or replaced with nozzles of a different size) in order to align with the horizontal joint of the diaphragm ring on this other end of the slot. Additionally, nozzle assemblies are designed with a predetermined gap between the upper-half nozzles and the lower-half nozzles proximate the horizontal joint. This gap helps to control the throat passing area, harmonic content and/or twisting of the rings at the horizontal joint. It may be difficult to measure and verify this gap due to the edge on the conventional nozzles, and it may also be difficult to hold the first nozzle in place when additional nozzles are forcibly loaded into the circumferential slot.

BRIEF DESCRIPTION OF THE INVENTION

Various embodiments include a steam turbine drum nozzle, along with a related assembly and steam turbine. Particular embodiments include a nozzle having: an airfoil; a radially inner sidewall coupled with a first end of the airfoil; and a radially outer sidewall coupled with a second end of the airfoil, the second end opposing the first end, wherein the radially outer sidewall includes: a first section radially outward of the airfoil; a thinned section coupled with the first section; and a second section coupled with the thinned section radially outward of the airfoil, the second section having a radially outer face and a circumferentially facing side abutting the radially outer face, wherein the second section includes a circumferentially extending slot, and wherein the second section includes a relief slot extending into a body of the second section from the circumferentially facing side.

A first aspect of the disclosure includes a nozzle having: an airfoil; a radially inner sidewall coupled with a first end of the airfoil; and a radially outer sidewall coupled with a second end of the airfoil, the second end opposing the first end, wherein the radially outer sidewall includes: a first section radially outward of the airfoil; a thinned section coupled with the first section; and a second section coupled with the thinned section radially outward of the airfoil, the second section having a radially outer face and a circumferentially facing side abutting the radially outer face, wherein the second section includes a circumferentially extending slot, and wherein the second section includes a relief slot extending into a body of the second section from the circumferentially facing side.

A second aspect of the disclosure includes a steam turbine having: a drum nozzle ring having a circumferentially extending slot therein; and a plurality of drum nozzles aligned within the circumferentially extending slot, at least one of the plurality of drum nozzles including: an airfoil; a radially inner sidewall coupled with a first end of the airfoil; and a radially outer sidewall coupled with a second end of the airfoil, the second end opposing the first end, wherein the radially outer sidewall includes: a first section radially outward of the airfoil; a thinned section coupled with the first section; and a second section coupled with the thinned section radially outward of the airfoil, the second section having a radially outer face and a circumferentially facing side abutting the radially outer face, wherein the second section includes a circumferentially extending slot, and wherein the second section includes a relief slot extending into a body of the second section from the circumferentially facing side.

A third aspect of the disclosure includes a non-transitory computer readable storage medium storing code representative of a steam turbine drum nozzle, the steam turbine drum nozzle physically generated upon execution of the code by a computerized additive manufacturing system, the code including: code representing the steam turbine drum nozzle, the steam turbine drum nozzle including: an airfoil; a radially inner sidewall coupled with a first end of the airfoil; and a radially outer sidewall coupled with a second end of the airfoil, the second end opposing the first end, wherein the radially outer sidewall includes: a first section radially outward of the airfoil; a thinned section coupled with the first section; and a second section coupled with the thinned section radially outward of the airfoil, the second section having a radially outer face and a circumferentially facing side abutting the radially outer face, wherein the second section includes a circumferentially extending slot, and wherein the second section includes a relief slot extending into a body of the second section from the circumferentially facing side.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
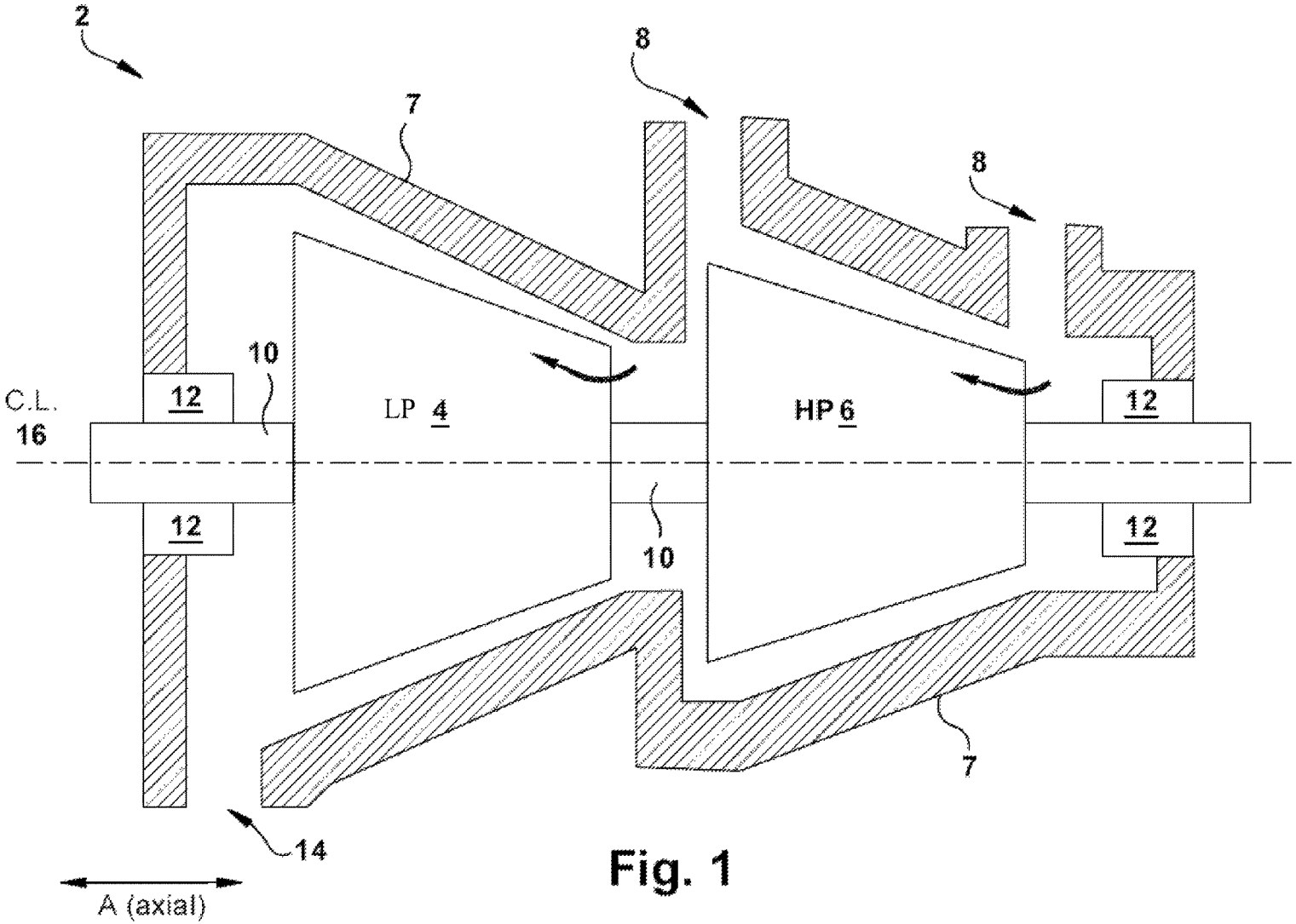
FIG. 1 shows a partial cross-sectional schematic view of steam turbine according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The subject matter disclosed herein relates to steam turbines. Specifically, the subject matter disclosed herein relates to nozzles in steam turbines.

According to various embodiments of the disclosure, a steam turbine drum nozzle includes at least one relief slot in the circumferentially facing side of the nozzle dovetail section. In various embodiments, the relief slot abuts the circumferentially extending slot at the radially outer face of the dovetail section. In some embodiments, the relief slot at least partially surrounds the circumferentially extending slot. In some embodiments, the relief slot extends from the circumferentially extending slot to an axially facing side of the dovetail section. In some embodiments, the relief slot can extend into the dovetail section from the circumferentially facing side of the nozzle dovetail section at an angle of approximately greater than zero degrees and less than five degrees (e.g., 1-5 degrees in some cases). In various embodiments, this relief slot extends at an angle from the circumferentially facing side such that it is substantially coplanar with the horizontal joint surface of the drum nozzle ring. The relief slot(s) can allow for improved alignment and/or installation of steam turbine drum nozzle(s) when compared with conventional nozzles and assemblies.

As denoted in these Figures, the "A" axis represents axial orientation (along the axis of the turbine rotor, sometimes referred to as the turbine centerline). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location. Identically labeled elements in the Figures depict substantially similar (e.g., identical) components.

Turning to FIG. 1, a partial cross-sectional schematic view of steam turbine 2 (e.g., a high-pressure/intermediate-pressure steam turbine) is shown. Steam turbine 2 may include, for example, a low pressure (LP) section 4 and a high pressure (HP) section 6 (it is understood that either LP section 4 or HP section 6 can include an intermediate pressure (IP) section, as is known in the art). The LP section 4 and HP section 6 are at least partially encased in casing 7. Steam may enter the HP section 6 and LP section 4 via one or more inlets 8 in casing 7, and flow axially downstream from the inlet(s) 8. In some embodiments, HP section 6 and LP section 4 are joined by a common shaft 10, which may contact bearings 12, allowing for rotation of the shaft 10, as working fluid (steam) forces rotation of the blades within each of LP section 4 and HP section 6. After performing mechanical work on the blades within LP section 4 and HP section 6, working fluid (e.g., steam) may exit through outlet 14 in casing 7. The center line (CL) 16 of HP section 6 and LP section 4 is shown as a reference point. Both LP section 4 and HP section 6 can include diaphragm assemblies, which are contained within segments of casing 7.

Figure 2:
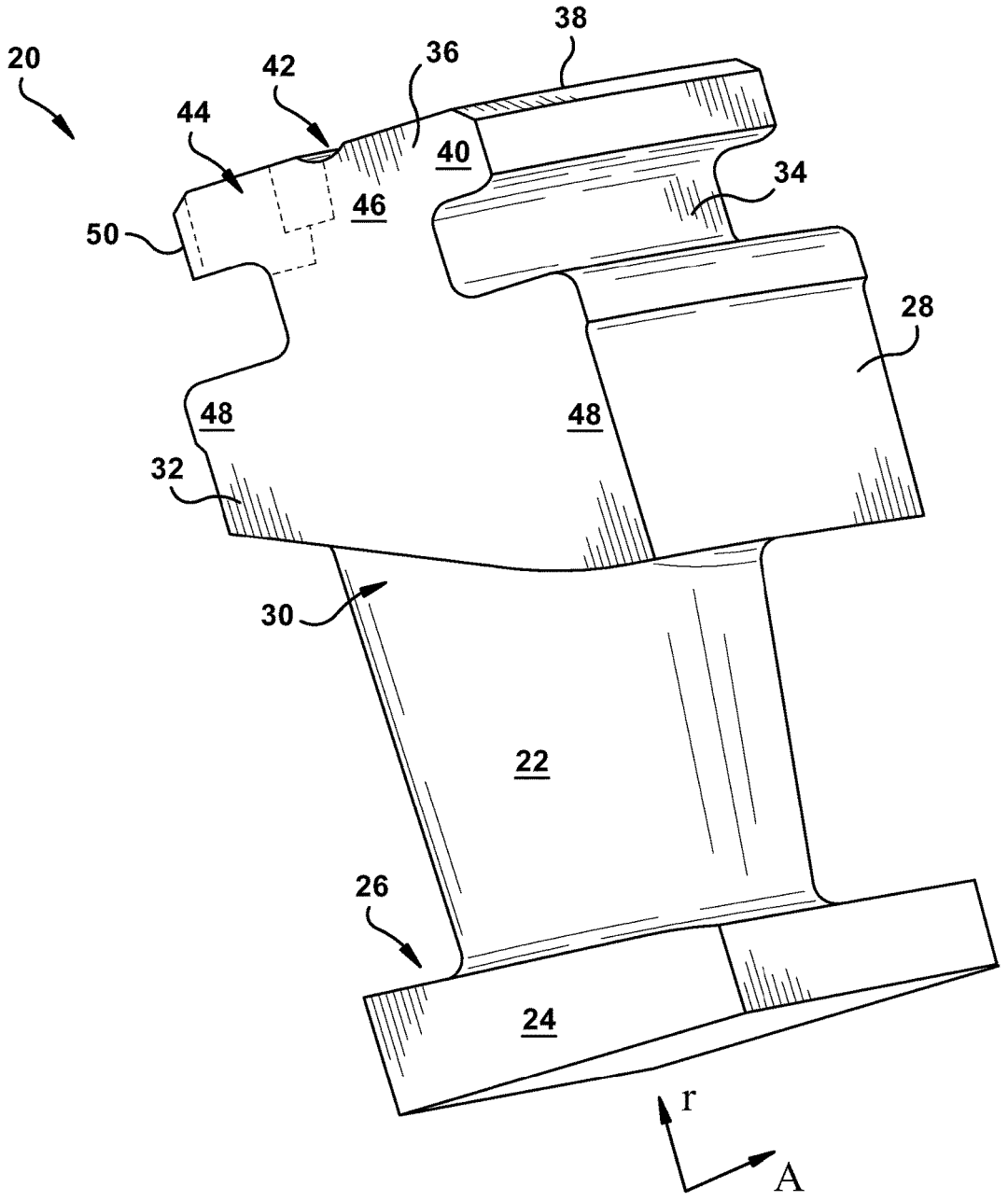
FIG. 2 shows a schematic perspective view of a drum rotor nozzle according to various embodiments of the disclosure.

FIG. 2 shows a schematic three-dimensional depiction of a steam turbine drum nozzle (or simply, drum nozzle, or nozzle) 20 according to various embodiments of the disclosure. Drum nozzle 20 can include an airfoil 22, a radially inner sidewall 24 coupled with a first end 26 of airfoil 22, and a radially outer sidewall 28 coupled with a second end 30 of airfoil 22, where second end 30 opposes first end 26. According to various embodiments, radially outer sidewall 28 includes: a first section 32 radially outward of airfoil 22, a thinned section 34 (having a reduced axial thickness relative to first section 32) coupled with first section 32, and a second section 36 (axially thicker than thinned section 34) coupled with thinned section 34 and located radially outward of airfoil 22. Second section 36 can have a radially outer face 38 and a circumferentially facing side 40 abutting the radially outer face 38. According to various embodiments, second section 36 includes a circumferentially extending slot 42 and a relief slot 44 extending into the second section 36 (into a body 46 of second section 36) from the circumferentially facing side 40. According to various embodiments, first section 32 includes a first set of axially extending protrusions 48, thinned section 34 is located radially outward of first section 32, and second section 36 includes a second set of axially extending protrusions 50 located radially outward of thinned section 34. In various embodiments, circumferentially extending slot 42 extends substantially entirely through the second section 36 (in circumferential direction) at radially outer face 38.

Figure 3:
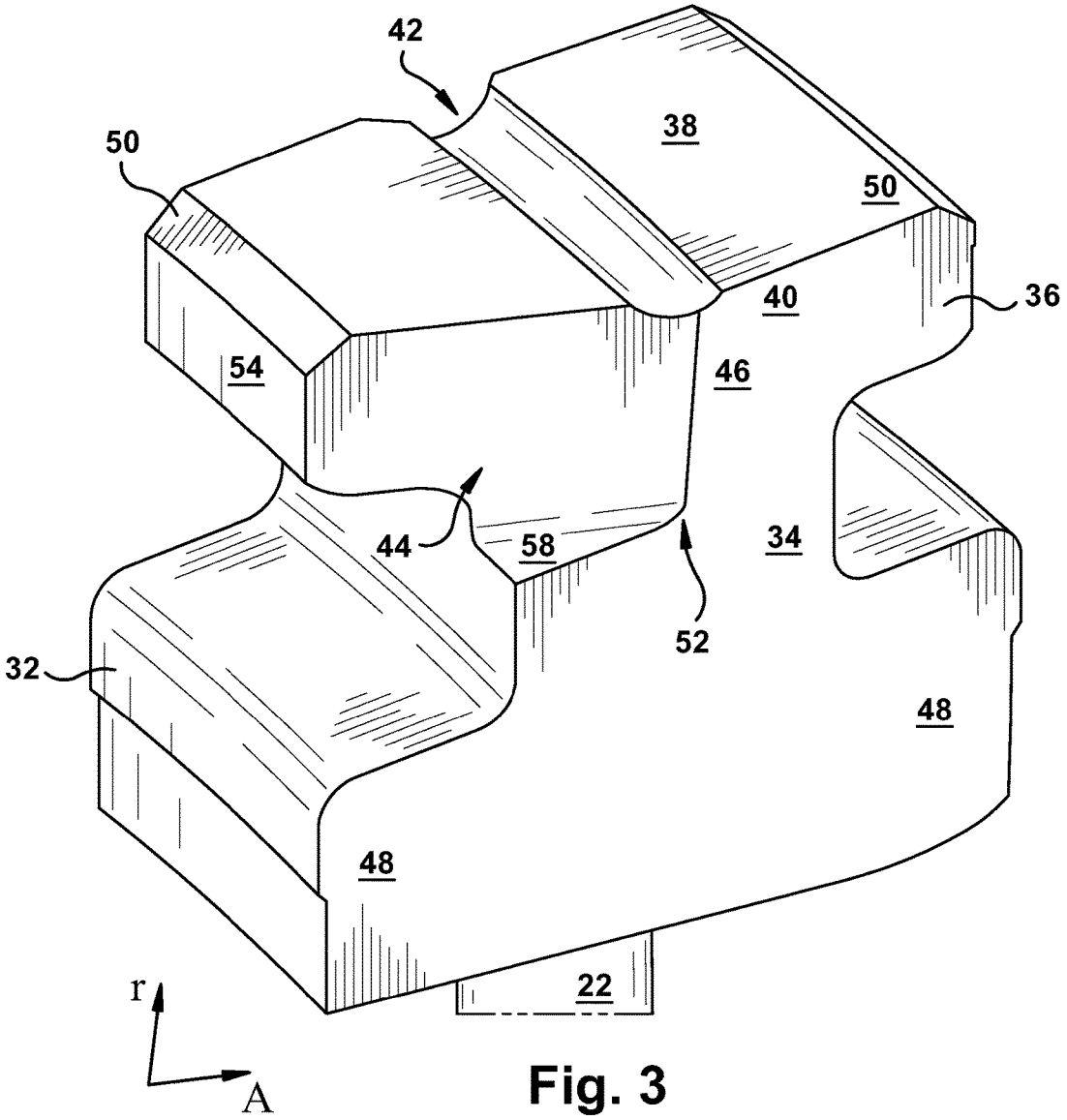
FIG. 3 shows a schematic partial perspective view of a drum rotor nozzle according to various embodiments of the disclosure.

FIG. 3 shows a close-up perspective view of a portion of drum nozzle 20 (FIG. 2) according to various embodiments. In some cases, drum nozzle 20 includes relief slot 44 which extends from an approximate axial midpoint 52 on circumferentially facing side 40 to an axially facing side 54 of second section 36. As discussed herein, relief slot 44 extends into body 46 of second section 36, such that it fits within the axial, circumferential and radial profile of second section 36. Even further, in various embodiments, relief slot 44 can extend radially beyond second section 36 and into thinned section 34, exposing a radially facing wall 58 in thinned section 34. According to various embodiments, relief slot 44 can abut (e.g., contact or nearly contact) circumferentially extending slot 42, e.g., proximate circumferentially facing side 40. Relief slot 44 can extend from circumferentially facing side 40 into second section 36 (body 46 of second section) at an angle of approximately less than five degrees (e.g., greater than zero degrees and up to approximately five degrees, and in some cases, between one and five degrees).

Figure 4:
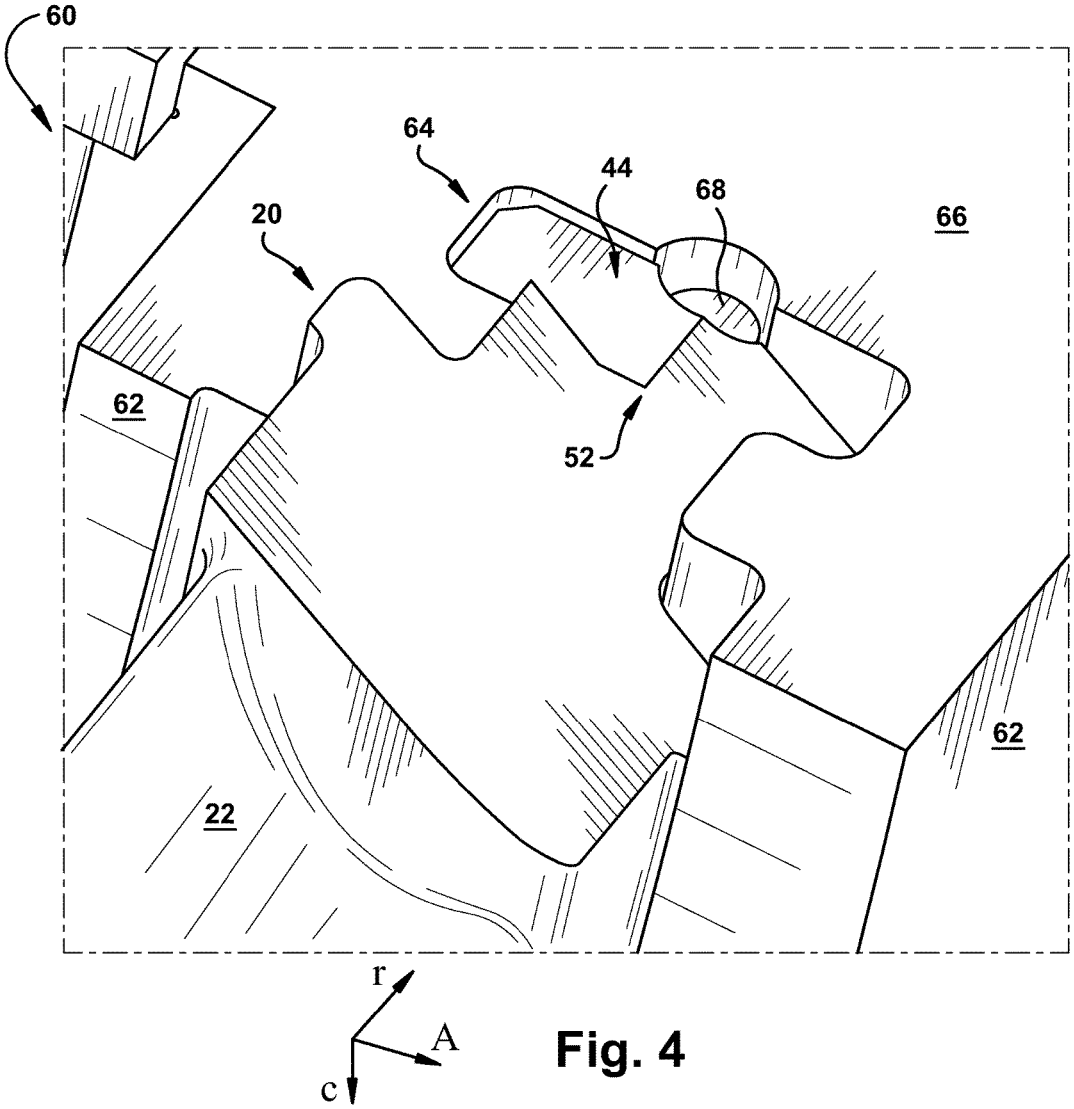
FIG. 4 shows a schematic perspective view of a portion of a steam turbine drum assembly according to various embodiments of the disclosure.

In some cases, drum nozzle 20 can include a starting or initial drum nozzle placed in a drum nozzle assembly 60, partially shown in the schematic perspective view in FIG. 4. That is, drum nozzle 20 can be placed as an initial nozzle in a drum nozzle ring 62 having a circumferentially extending slot 64 therein. As shown, drum nozzle 20 including relief slot 44 can fit within drum nozzle ring 62 proximate the horizontal joint surface 66 of drum nozzle ring 62. As is known in the art, the horizontal joint surface 66 is a location (or plane) on each circumferential end of the halves that form drum nozzle ring 62 about a rotor. Each horizontal joint surface 66 is designed to interface with an opposing horizontal joint surface on its corresponding other half of drum nozzle ring 62. In the case that drum nozzle 20 includes an initial nozzle in drum nozzle ring 62, drum nozzle 20 can be retained in slot 64 using a pin 68, which can be pressure fit (e.g., wedged, hammered or otherwise physically displaced) between inner walls of slot 64 and circumferentially extending slot 42. According to various embodiments, relief slot 44 allows for alignment and spacing between nozzle 20 and horizontal joint surface 66, as well as the counterpart nozzle 20 in the complementing half of drum nozzle ring 62.

Figure 5:
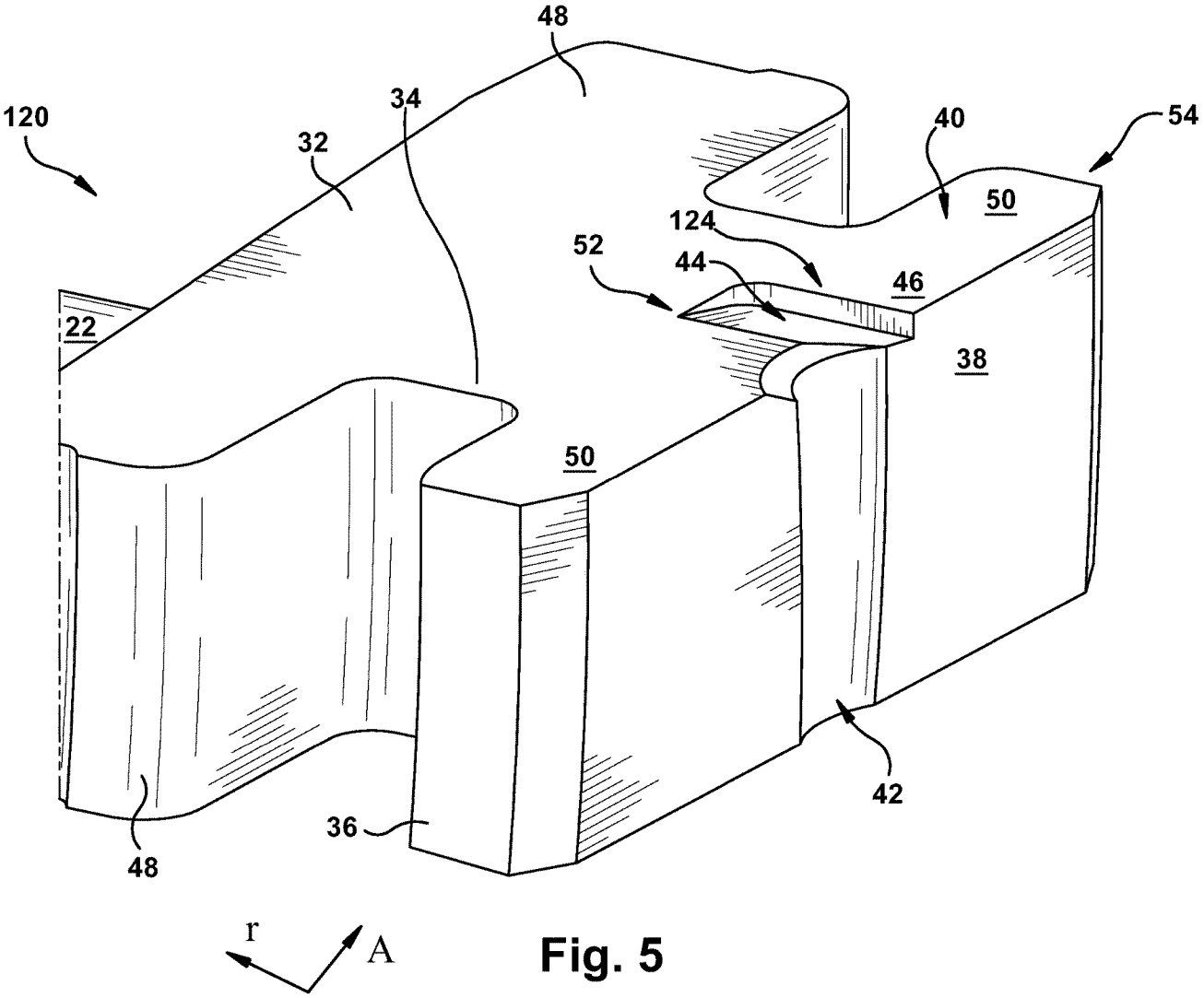
FIG. 5 shows a schematic partial perspective view of a drum rotor nozzle according to various embodiments of the disclosure.
Figure 6:
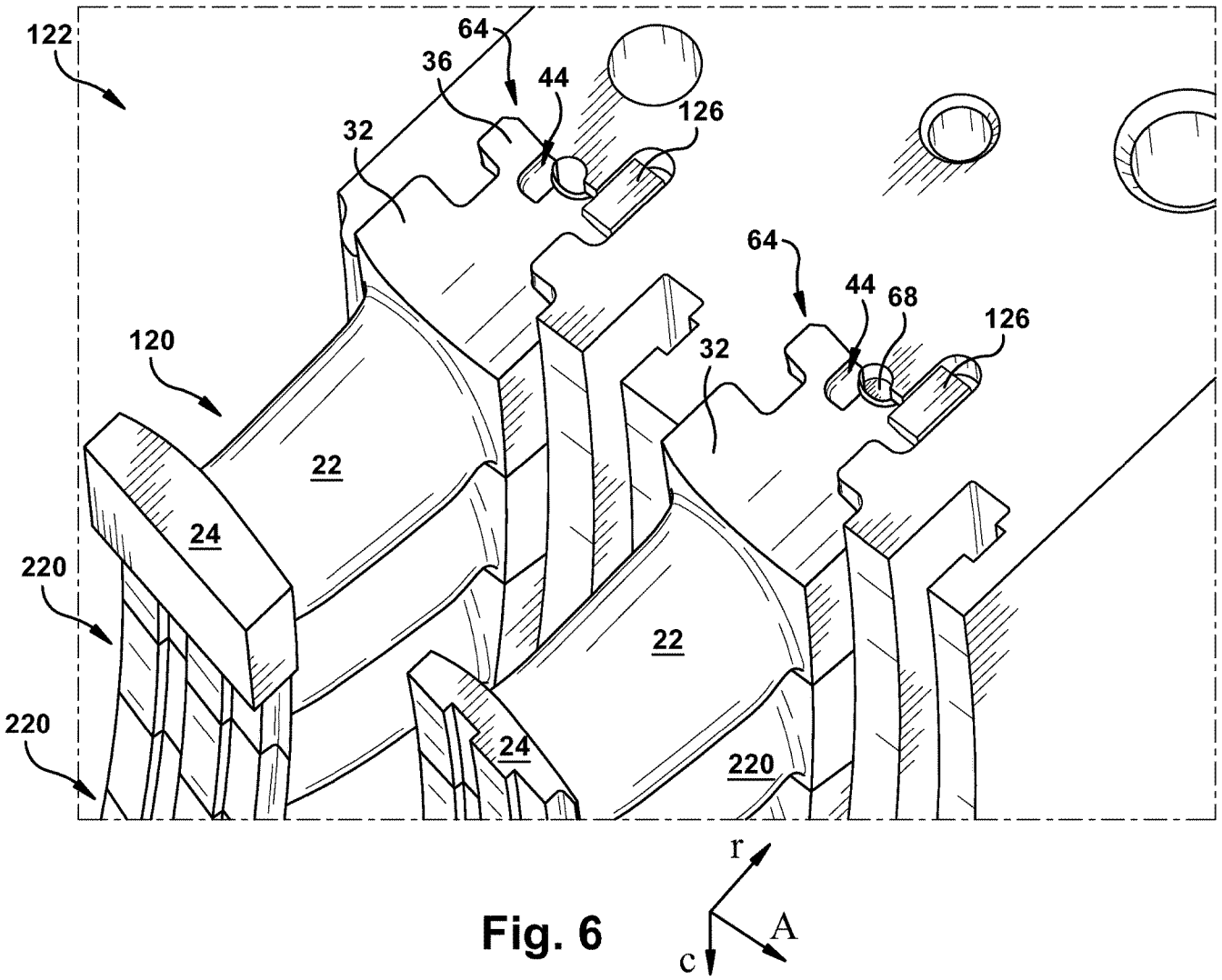
FIG. 6 shows a schematic perspective view of a portion of a steam turbine drum assembly according to various embodiments of the disclosure.

FIG. 5 shows an alternative embodiment of a drum nozzle 120, which can include a closure or last drum nozzle in a drum nozzle assembly 122 (FIG. 6), including a plurality of additional nozzles 220. It is understood that similar numbering between the FIGURES can represent substantially similar components, and redundant explanation is omitted for clarity of description. In these embodiments, drum nozzle 120 includes relief slot 44, which extends approximately from axial midpoint 52 to a location 124 axially inboard of axially facing surface (side) 54 (obstructed in this view) of second section 36. In some cases, relief slot 44 at least partially surrounds circumferentially extending slot 42 (e.g., along the axial plane), and in various embodiments, relief slot 44 (as in drum nozzle 20) abuts circumferentially extending slot 42. Relief slot 44 can extend radially into thinned section 34 in some embodiments, and in various cases, relief slot 44 can extend from circumferentially facing side 40 into second section 36 (body 46 of second section 36) at an angle of approximately less than five degrees (e.g., greater than zero degrees and up to approximately five degrees, and in some cases, between one and five degrees). In some cases, as shown in drum nozzle assembly 122 of FIG. 6, drum nozzle 120 can be at least partially retained within circumferentially extending slot 64 by a key member 126, where key member 126 can at least partially restrict rotation of drum nozzle 120 within circumferentially extending slot 64. Drum nozzle 20, 120 (FIGS. 2-6) may be formed in a number of ways. In one embodiment, Drum nozzle 20, 120 may be formed by casting, forging, welding and/or machining. In one embodiment, however, additive manufacturing is particularly suited for manufacturing drum nozzle 20, 120 (FIGS. 2-6). As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic, much of which is cut away and discarded, the only material used in additive manufacturing is what is required to shape the part. Additive manufacturing processes may include but are not limited to: 3D printing, rapid prototyping (RP), direct digital manufacturing (DDM), selective laser melting (SLM) and direct metal laser melting (DMLM). In the current setting, DMLM has been found advantageous.

Figure 7:
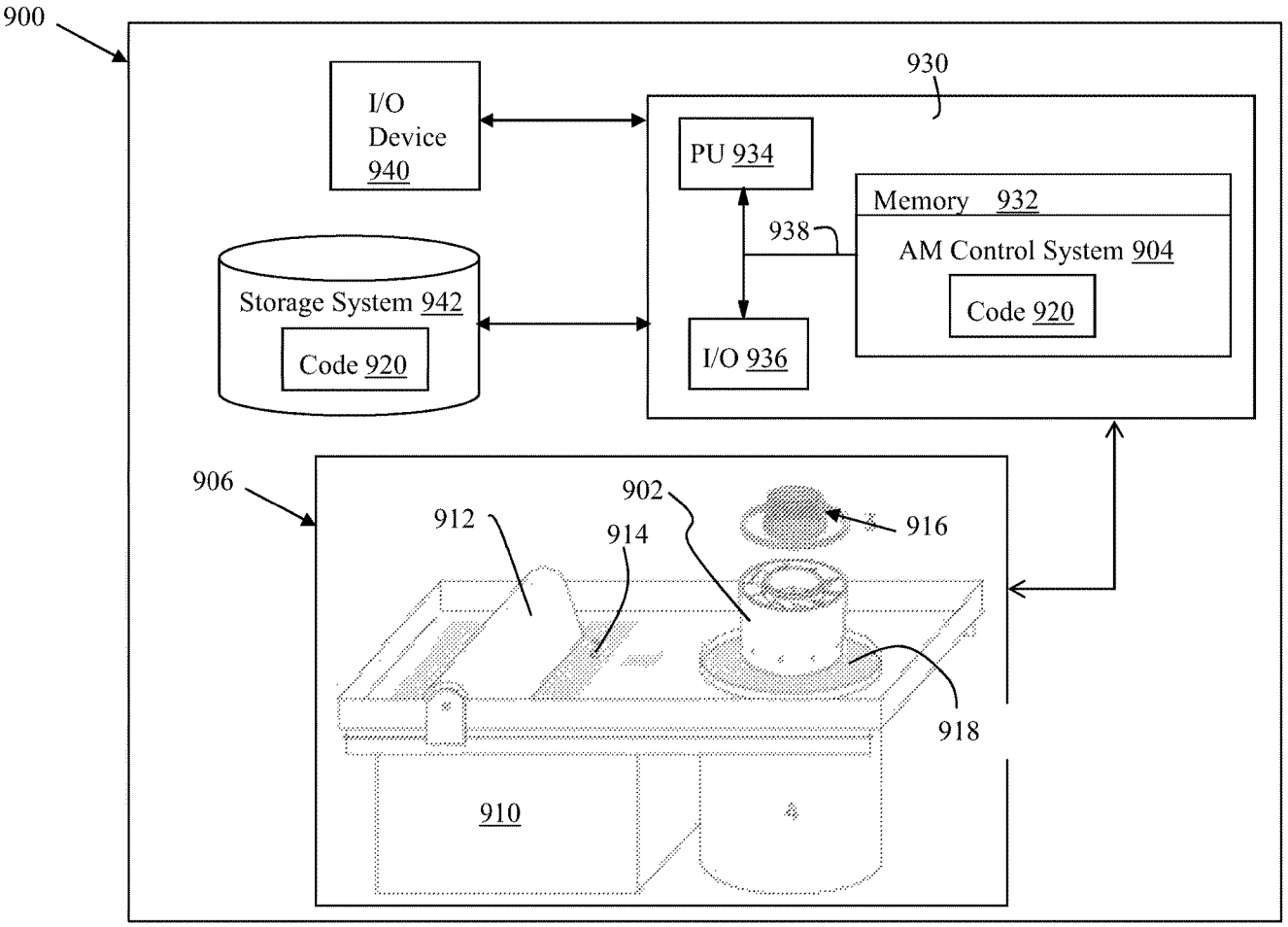
FIG. 7 shows a block diagram of an additive manufacturing process including a non-transitory computer readable storage medium storing code representative of a template according to embodiments of the disclosure.

To illustrate an example of an additive manufacturing process, FIG. 7 shows a schematic/block view of an illustrative computerized additive manufacturing system 900 for generating an object 902. In this example, system 900 is arranged for DMLM. It is understood that the general teachings of the disclosure are equally applicable to other forms of additive manufacturing. Object 902 is illustrated as a double walled turbine element; however, it is understood that the additive manufacturing process can be readily adapted to manufacture drum nozzle 20, 120 (FIGS. 2-6). AM system 900 generally includes a computerized additive manufacturing (AM) control system 904 and an AM printer 906. AM system 900, as will be described, executes code 920 that includes a set of computer-executable instructions defining drum nozzle 20, 120 (FIGS. 2-6) to physically generate the object using AM printer 906. Each AM process may use different raw materials in the form of, for example, fine-grain powder, liquid (e.g., polymers), sheet, etc., a stock of which may be held in a chamber 910 of AM printer 906. In the instant case, drum nozzle 20, 120 (FIGS. 2-6) may be made of plastic/polymers or similar materials. As illustrated, an applicator 912 may create a thin layer of raw material 914 spread out as the blank canvas from which each successive slice of the final object will be created. In other cases, applicator 912 may directly apply or print the next layer onto a previous layer as defined by code 920, e.g., where the material is a polymer. In the example shown, a laser or electron beam 916 fuses particles for each slice, as defined by code 920, but this may not be necessary where a quick setting liquid plastic/polymer is employed. Various parts of AM printer 906 may move to accommodate the addition of each new layer, e.g., a build platform 918 may lower and/or chamber 910 and/or applicator 912 may rise after each layer.

AM control system 904 is shown implemented on computer 930 as computer program code. To this extent, computer 930 is shown including a memory 932, a processor 934, an input/output (I/O) interface 936, and a bus 938. Further, computer 930 is shown in communication with an external I/O device/resource 940 and a storage system 942. In general, processor 934 executes computer program code, such as AM control system 904, that is stored in memory 932 and/or storage system 942 under instructions from code 920 representative of drum nozzle 20, 120 (FIGS. 2-6), described herein. While executing computer program code, processor 934 can read and/or write data to/from memory 932, storage system 942, I/O device 940 and/or AM printer 906. Bus 938 provides a communication link between each of the components in computer 930, and I/O device 940 can comprise any device that enables a user to interact with computer 940 (e.g., keyboard, pointing device, display, etc.). Computer 930 is only representative of various possible combinations of hardware and software. For example, processor 934 may comprise a single processing unit, or be distributed across one or more processing units in one or more locations, e.g., on a client and server. Similarly, memory 932 and/or storage system 942 may reside at one or more physical locations. Memory 932 and/or storage system 942 can comprise any combination of various types of non-transitory computer readable storage medium including magnetic media, optical media, random access memory (RAM), read only memory (ROM), etc. Computer 930 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 932, storage system 942, etc.) storing code 920 representative of drum nozzle 20, 120 (FIGS. 2-6). As noted, code 920 includes a set of computer-executable instructions defining outer electrode that can be used to physically generate the tip, upon execution of the code by system 900. For example, code 920 may include a precisely defined 3D model of outer electrode and can be generated from any of a large variety of well-known computer aided design (CAD) software systems such as AutoCAD®, TurboCAD®, DesignCAD 3D Max, etc. In this regard, code 920 can take any now known or later developed file format. For example, code 920 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 920 may be translated between different formats, converted into a set of data signals and transmitted, received as a set of data signals and converted to code, stored, etc., as necessary. Code 920 may be an input to system 900 and may come from a part designer, an intellectual property (IP) provider, a design company, the operator or owner of system 900, or from other sources. In any event, AM control system 904 executes code 920, dividing drum nozzle 20, 120 (FIGS. 2-6) into a series of thin slices that it assembles using AM printer 906 in successive layers of liquid, powder, sheet or other material. In the DMLM example, each layer is melted to the exact geometry defined by code 920 and fused to the preceding layer. Subsequently, the drum nozzle 20, 120 (FIGS. 2-6) may be exposed to any variety of finishing processes, e.g., minor machining, sealing, polishing, assembly to other part of the igniter tip, etc.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., soldering, fastening, ultrasonic welding, bonding). In various embodiments, electronic components described as being "coupled" can be linked via conventional hard-wired and/or wireless means such that these electronic components can communicate data with one another.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine drum nozzle comprising:

an airfoil;

a radially inner sidewall coupled with a first end of the airfoil; and a radially outer sidewall coupled with a second end of the airfoil, the second end opposing the first end, wherein the radially outer sidewall includes:

a first section radially outward of the airfoil;

a thinned section coupled with the first section; and a second section coupled with the thinned section radially outward of the airfoil, the second section having a radially outer face and a circumferentially facing side abutting the radially outer face, wherein the second section includes a circumferentially extending slot, wherein the second section includes a relief slot extending into a body of the second section from the circumferentially facing side, and wherein the relief slot extends from an approximate axial midpoint on the circumferentially facing side to a location axially inboard of an axially facing surface of the second section.

2. The steam turbine drum nozzle of claim 1, wherein the first section includes a first set of axially extending protrusions, the thinned section is radially outward of the first set of axially extending protrusions, and the second section includes a second set of axially extending protrusions radially outward of the thinned section.

3. The steam turbine drum nozzle of claim 1, wherein the circumferentially extending slot extends substantially entirely through the second section at the radially outer face.

4. The steam turbine drum nozzle of claim 1, wherein the relief slot at least partially surrounds the circumferentially extending slot.

5. The steam turbine drum nozzle of claim 1, wherein the relief slot abuts the circumferentially extending slot.

6. The steam turbine drum nozzle of claim 1, wherein the relief slot extends from the circumferentially facing side into the second section at an angle of approximately between one degree and five degrees.

7. The steam turbine drum nozzle of claim 1, wherein the relief slot has a circumferentially facing surface and is configured to align the circumferentially facing surface of the relief slot with a horizontal joint surface of a drum nozzle ring, the horizontal joint surface of the drum nozzle ring being a plane on a circumferential end of one of two halves that form the drum nozzle ring.

8. The steam turbine drum nozzle of claim 7, wherein the alignment of the circumferentially facing surface of the relief slot with the horizontal joint surface of the drum nozzle ring includes the circumferentially facing surface of the relief slot being coplanar with the horizontal joint surface of the drum nozzle ring.

9. A steam turbine comprising:

a drum nozzle ring having a first circumferentially extending slot therein; and a plurality of drum nozzles aligned within the first circumferentially extending slot, at least one of the plurality of drum nozzles including:

an airfoil;

a radially inner sidewall coupled with a first end of the airfoil; and a radially outer sidewall coupled with a second end of the airfoil, the second end opposing the first end, wherein the radially outer sidewall includes:

a first section radially outward of the airfoil;

a thinned section coupled with the first section; and a second section coupled with the thinned section radially outward of the airfoil, the second section having a radially outer face and a circumferentially facing side abutting the radially outer face, wherein the second section includes a second circumferentially extending slot, wherein the second section includes a relief slot extending into a body of the second section from the circumferentially facing side, and wherein the relief slot extends from an approximate axial midpoint on the circumferentially facing side to a location axially inboard of an axially facing surface of the second section.

10. The steam turbine of claim 9, wherein the first section includes a first set of axially extending protrusions, the thinned section is radially outward of the first set of axially extending protrusions, and the second section includes a second set of axially extending protrusions radially outward of the thinned section.

11. The steam turbine of claim 9, wherein the second circumferentially extending slot extends substantially entirely through the second section at the radially outer face.

12. The steam turbine of claim 9, wherein the relief slot at least partially surrounds the second circumferentially extending slot.

13. The steam turbine of claim 9, wherein the relief slot abuts the second circumferentially extending slot.

14. The steam turbine of claim 9, wherein the relief slot extends from the circumferentially facing side into the second section at an angle of approximately between one degree and five degrees.

15. The steam turbine of claim 9, wherein the drum nozzle ring is at least partially contained within a stator section.

16. The steam turbine of claim 15, further comprising a rotor section at least partially surrounded by the stator section.

17. The steam turbine of claim 9, wherein the relief slot has a circumferentially facing surface and is configured to align the circumferentially facing surface of the relief slot with a horizontal joint surface of the drum nozzle ring, the horizontal joint surface of the drum nozzle ring being a plane on a circumferential end of one of two halves that form the drum nozzle ring.

18. The steam turbine of claim 17, wherein the alignment of the circumferentially facing surface of the relief slot with the horizontal joint surface of the drum nozzle ring includes the circumferentially facing surface of the relief slot being coplanar with the horizontal joint surface of the drum nozzle ring.

* * * * *